US005503537A

United States Patent [19]

Schlossarczyk et al.

[11] Patent Number: 5,503,537

[45] Date of Patent: Apr. 2, 1996

[54] GAS COMPRESSOR

[75] Inventors: Heinrich Schlossarczyk, Wennigsen; Werner Heger, Lehrte, both of Germany

[73] Assignee: WABCO Vermogensverwaltungs GmbH, Hanover, Germany

[21] Appl. No.: 263,928

[22] Filed: Jun. 21, 1994

[30] Foreign Application Priority Data

Jun. 24, 1993 [DE] Germany ..... 43 21 013.9

[51] Int. Cl.[6] ..... F04B 49/22

[52] U.S. Cl. ..... 417/296; 417/439; 417/306

[58] Field of Search ..... 417/296, 442, 417/306, 560, 439, 442, 540

[56] References Cited

U.S. PATENT DOCUMENTS

| | | | |
|---|---|---|---|
| 1,248,119 | 11/1917 | Holdsworth | 417/306 |
| 1,334,281 | 3/1920 | Constantinesco | 417/540 |
| 1,653,110 | 12/1927 | Valley | 417/296 |
| 2,594,815 | 4/1952 | Smith | 417/253 |
| 2,913,985 | 11/1959 | Harrison | 417/306 |
| 3,291,054 | 12/1966 | McKenzie | 417/296 |
| 4,407,640 | 10/1983 | Namekata | 417/296 |
| 4,519,750 | 5/1985 | Kurahashi et al. | 417/296 |
| 4,534,710 | 8/1985 | Higuchi et al. | 417/312 |
| 4,594,059 | 6/1986 | Decker | 417/540 |

FOREIGN PATENT DOCUMENTS

| | | |
|---|---|---|
| 265498 | 10/1968 | Austria . |
| 7047476 | 9/1971 | France . |
| 1076152 | 5/1962 | Germany . |
| 1157343 | 11/1963 | Germany . |
| 3214713 | 10/1983 | Germany . |
| 3329790 | 2/1985 | Germany . |
| 3642852 | 6/1988 | Germany . |
| 3909531 | 6/1990 | Germany . |
| 3904169 | 8/1990 | Germany . |
| 829060 | 2/1960 | United Kingdom . |

*Primary Examiner*—Richard A. Bertsch
*Assistant Examiner*—Peter G. Korytnyk
*Attorney, Agent, or Firm*—Meltzer, Lippe, Goldstein

[57] ABSTRACT

The present invention relates to a gas compressor which prevents noise being produced in the suction conduit during idling. In conventional systems, the noise results from the collision of arriving and returning gas by means of a check valve provided between the suction chamber and the suction conduit. The present invention avoids this noise by providing an additional chamber which is connected via an admixture valve to the compression chamber (20) during the idling operation. This invention is especially applicable to pneumatic systems in automotive technology.

18 Claims, 4 Drawing Sheets

GAS COMPRESSOR

FIELD OF THE INVENTION

The instant invention relates to a gas compressor which can be switched between operation under load and idling. It specifically relates to a gas compressor which has a compression chamber, a suction chamber connected to the compression chamber via at least one suction valve, and an outlet chamber connected to the compression chamber via an outlet valve.

BACKGROUND OF THE INVENTION

Such a gas compressor is also known from DE 39 09 531 A1, e.g., FIG. 5. This conventional gas compressor prevents back-flow from the compression chamber via the suction chamber into the suction line during idling by means of a check valve which is located between the suction chamber and the suction line. The check valve only allows flow in the direction of the suction line into the suction chamber. In this manner, the known gas compressor prevents arriving and returning gases from meeting each other and, thereby, prevents noise-producing pulsations of the suction line and of the gas column within the suction line during idling. It also prevents energy losses produced by these pulsations. However, when the known gas compressor is operated the check valve located between the suction chamber and the suction line, and particularly the valve body, may produce noise.

It is, therefore, an object of the instant invention to reduce the risk of noise production in a gas compressor of the above-mentioned type by simple means.

SUMMARY OF THE INVENTION

The present invention is suitable for all types of gas compressor designs, whatever the principle of operation in any individual case. The invention is also suitable for all types of gases. Only as an example, the air compressor using piston construction, such as the one normally used in automotive engineering, is mentioned as a special area of application.

The entire delivery volume of the gas compressor must pass through the check valve of the known gas compressor located between the suction chamber and the suction line as it is being aspired. The resulting flow losses may reduce the delivery, that is the volumetric efficiency, during operation under load. An object of the present invention is to avoid this disadvantage. The inventive gas compressor requires a lower expenditure for components than the known gas compressor so that a cost advantage results in addition to savings on possible sources of malfunction. An increase of operational reliability can thereby ensue. In one embodiment of the invention, a gas compressor which is switchable between operation under load and idling operations is provided. The gas compressor comprises a compression chamber, a suction chamber which is connected via at least one suction valve to the compression chamber, an outlet chamber which is connected via at least one outlet valve to the compression chamber, and an additional chamber which is connected during the idling operation to the compression chamber by an additional valve.

In another embodiment of the present invention, a closing valve is provided which locks the connection between the compression chamber and the outlet chamber during the idling operation.

In yet another embodiment of the invention, an overpressure valve is provided which limits the pressure in the compression chamber and the additional chamber.

In still another embodiment of the invention, an extra suction valve is provided which connects the compression chamber to an atmospheric environment free relief chamber.

In another embodiment of the invention, a gas compressor which is switchable between load and idling operations is provided. The gas compressor comprises at least two compression chambers, a suction chamber connected to a first compression chamber via at least one suction valve and to a second compression chamber via at least one additional suction valve. The second compression chamber has a size which changes in opposition to the size of the first compression chamber. The compressor further comprises an outlet chamber connected via a first outlet valve to the first compression chamber and via a second outlet valve to the second compression chamber, a channel which connects the first compression chamber to the second compression chamber, an additional chamber which is connected during the idling operation to one of the two compression chambers via a first additional valve and a second admixture valve connecting the other of the two compression chambers to the channel during the idling operation. The additional chamber comprises the channel and one of the two compression chambers.

In yet another embodiment of the invention, the second compression chamber is connected to an additional suction chamber via the at least one additional suction valve and to an additional outlet chamber via the at least one additional outlet valve.

In still another embodiment of the invention, a closing valve is provided for locking the connection between the two compression chambers and the outlet chamber during the idling operation.

In another embodiment of the invention, an overpressure valve is provided for limiting the pressure in each of the two compression chambers and in each related additional chamber.

In another embodiment of the invention, an extra suction valve is provided for connecting at least one of the compression chambers to an atmospheric pressure environment or chamber.

Further advantages of the invention are indicated in the following explanation with the examples of embodiments shown in drawings.

DETAILED DESCRIPTION OF THE INVENTION

Figure 1A:
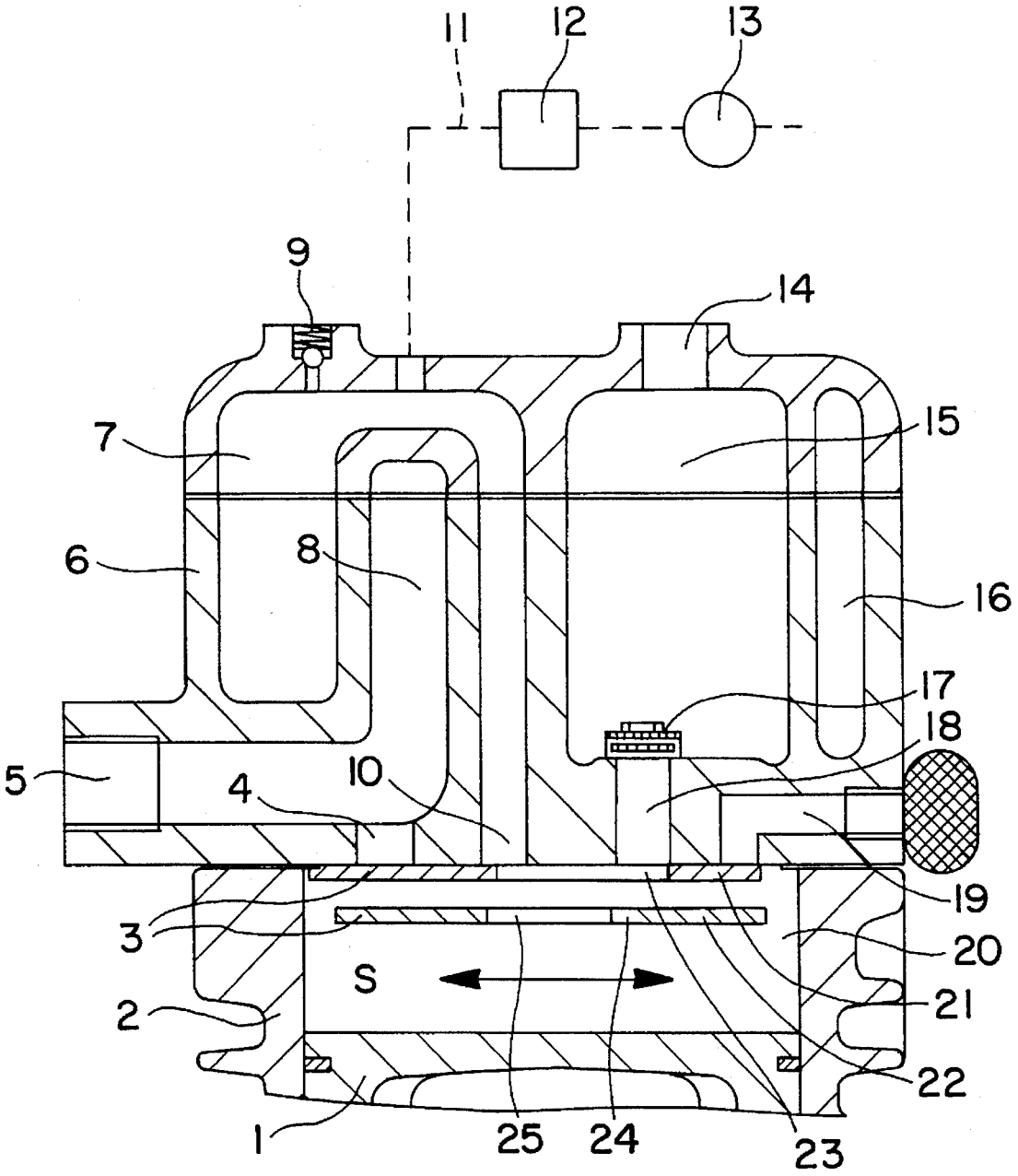
FIG. 1*a* shows a gas compressor in piston construction, with a compression chamber in idle position
Figure 1B:
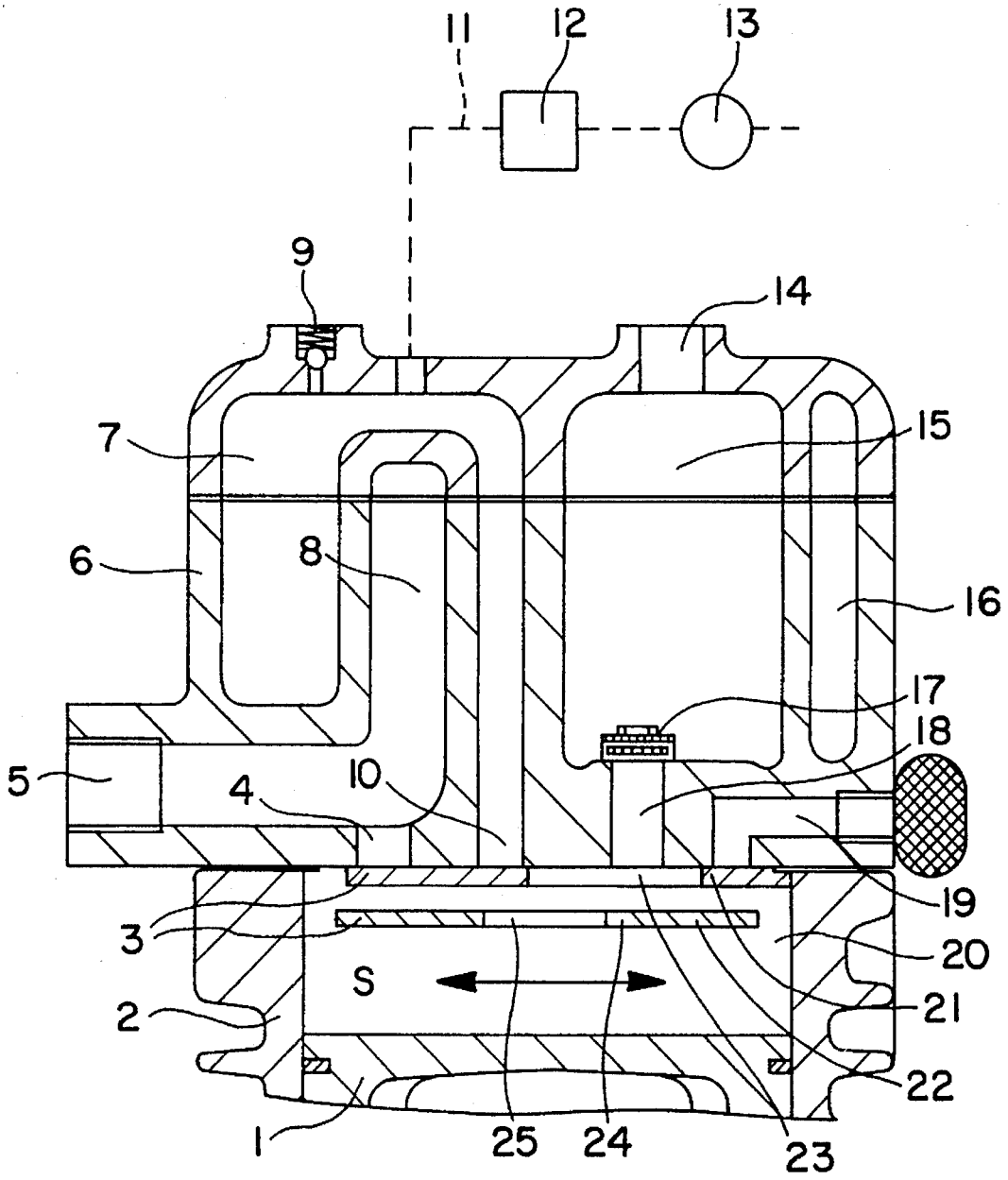
FIG. 1*b* shows a gas compressor in piston construction, with a compression chamber in load position

The gas compressor shown in FIGS. 1*a* and 1*b*, having one compression chamber is usually designated as a "single cylinder compressor". The compressor has a piston (1) which is generally movable within a cylinder (2) equipped with sealing elements, not specifically designated, which is movable in a known manner in a cylinder (2). At the end across from the piston (1), the cylinder (2) is sealingly closed off by a cylinder head (6) consisting of a cover and a cylinder head element.

The piston (1) is moved by a crank gear in a known manner alternately in a compression stroke towards the cylinder head (6) and in a suction stroke away from the cylinder head (6).

The piston (1), the cylinder (2) and the cylinder head (6) enclose the compression chamber (20) between them. The compression chamber (20) is of variable size and is composed of the space swept by the piston (1) in its suction stroke or in its compression stroke and of the remaining space, i.e., the dead space, not swept by the piston (1).

The cylinder head (6) contains a suction chamber (8), an outlet chamber (15) and an additional chamber (7). A coolant fluid chamber (16) is provided in the cylinder head (6). The suction chamber (8) is shown surrounded by the additional chamber (7). However, the suction chamber can also surround the additional chamber or be located next to the latter in a manner not shown here. The layout will often depend on the required size of the additional chamber. One or both of the above-mentioned chambers may possibly be formed by inserts contained within each other or placed next to each other in the cylinder head or in the cylinder.

The suction chamber (8) is connected to an inlet (5) in the cylinder head (6) by which it can be connected in the usual manner to a suction conduit, an aspiration filter or similar device. The outlet chamber (15) is connected to an outlet (14) in the cylinder head (6) through which it can be connected in a known manner via an outlet conduit to a user installation. The cylinder head (6) is provided with passages (4), (18) and (10) going from the suction chamber (8), the outlet chamber (15) and the additional chamber (7), respectively, in the direction of the compression chamber (20).

An outlet valve body (17) is supported in a suitable manner on the cylinder head (6) in the outlet chamber (15). The position of the outlet valve body (17) is determined by the difference of pressures in the compression chamber (20) and in the outlet chamber (15). In the case of pressure surplus in the outlet chamber (15), the outlet valve body (17) is pressed against the passage (18) between the outlet chamber (15) and the compression chamber (20), thereby closing the passage (18). In the case of pressure surplus in the compression chamber (20), the outlet valve body (17) is lifted away from the breach (18), thereby opening the breach (18). The outlet valve body (17) and the breach (18) thus constitute an outlet valve.

An inlet valve body (21) is installed in the compression chamber (20). The inlet valve body (21) can be shifted or swivelled by means of a drive, not shown, between an idling position and a load position as indicated by a double arrow (S). The inlet valve body (21) slides on the surface of the cylinder head (6) facing the compression chamber (20) during this movement. Barring anything to the contrary in the following description, the inlet valve body (21) is identical with known valve bodies as described in the form of valve disks, including-possible drives in DE 33 29 790 A1, DE 36 42 852 A1 and DE 39 04 172 A1.

In FIG. 1*a*, the inlet valve body 21 is shown in its idling position.

In FIG. 1*b*, the inlet valve body (21) is shown in its load position.

The inlet valve body (21) is provided with a closed area (3) by which it overlaps the passage (4) between the suction chamber (8) and the compression chamber (20) in its idling and load positions. The inlet valve body (21) can be elastically bent. Due to its bending elasticity, it is lifted from the passage (4) by a pressure surplus in the suction chamber (8), such as occurs in the suction stroke of the piston (1). It is pressed on the passage (4) in the case of a pressure surplus in the compression chamber (20), such as occurs during the compression stroke of the piston (1). The inlet valve body (21) and the passage (4) thus constitute an inlet valve (4, 21). The closed area (3) of the inlet valve body (21) is positioned and designed in such manner that it overlaps, during the load position of the inlet valve body (21), the passage (10) between the additional chamber (7) and the compression chamber (20). The inlet valve body (21) is, however, provided with an open area (23) adjoining the closed area (3). This open area (23) is placed and assigned in such manner that it exposes the passage (10) at least partially in the idling position of the inlet valve body (21) and, thereby, opens a connection between the additional chamber (7) and the compression chamber (20). The inlet valve body (21) and the passage (10) between the additional chamber (7) and the compression chamber (20) thus constitute an additional valve (10, 21) connecting the additional chamber (7) to the compression chamber (20).

The above-mentioned open area (23) is also placed and designed in such manner that it does not influence the passage (18) between the outlet chamber (15) and the compression chamber (20) in the load or idling positions of the inlet valve body (21).

In the basic embodiment described so far the gas compressor functions as follows.

In the load operation (FIG. 1*b*) and during the compression stroke, when the pressure in the compression chamber (20) has exceeded the pressure in the outlet chamber (15), the outlet valve (17, 18) being open and the inlet valve (4, 21) and additional valve (10, 21) being closed, the piston (1) pushes the gas which is present in the piston swept space at the beginning of the compression stroke into the outlet chamber (15) and from the outlet chamber into the outlet conduit, etc. In the load operation during the suction stroke, when the pressure in the compression chamber (20) drops below the pressure in the suction chamber (8), with the outlet valve (17, 18) and additional valve (10, 21) being closed, the piston (1) sucks gas via the elastically open inlet valve (4, 21) from the suction chamber (8) and expels it in the following compression stroke, as described above. In the idling operation (FIG. 1*a*), the action of the gas compressor depends on whether the outlet chamber (15) is free of overpressure or subjected to overpressure during the idling operation. The outlet chamber (15) is free of overpressure when the control of the delivery volume of the gas compressor is effected through expulsion of the gas, which is present in the piston-swept space at the beginning of the compression stroke into an overpressure free relief environment or chamber. In the case of air, this environment is the atmosphere. This type of control is called "pressure regulator control" in auto-technology and hereinafter as described below. The outlet chamber (15) is subjected to overpressure, i.e., to the pressure prevailing in the user installation, if the delivery volume control of the gas compressor follows a control principle called "governor control" in automotive technology and hereinafter.

In the case of pressure regulator control, the expulsion is substantially free of overpressure, except for a slight overpressure caused by flow resistances of the outlet valve (17, 18) and at the conduits and devices following the outlet chamber (15). This enables the power draw of the gas compressor in the idling operation to be determined essentially by its mechanical losses.

In the case of governor control, the outlet valve (17, 18) is kept closed by the pressure in the outlet chamber (15) during the idling operation (FIG. 1*a*). During the compression stroke, the piston (1) pushes the gas, which is present in the piston-swept space at the beginning of the compression stroke, through the open additional valve (10, 21) into the additional chamber (7). This gas is thereby compressed to a pressure which depends on the size of the additional chamber (7) and the dead space. This pressure is called "idling stabilization pressure". During the subsequent suction stroke of the piston (1), the gas flows through the open additional valve (10, 21) back into the compression chamber (20). In this process, the compression work done by the piston (1) in the compression stroke is extensively recovered, therefore, the idling power draw of the gas compressor is substantially determined by its mechanical losses. If gas flows past the sealing elements during the compression stroke of the piston (1), gas loss is compensated for from the suction chamber (8) via the opening inlet valve (4, 21) during the suction stroke of the piston (1).

In the case of governor control, the piston (1) during the idling operation moves during the compression stroke against overpressure, and during the suction stroke at least partly under overpressure. This is advantageous because the lubricating oil consumption during idling is eliminated or at least decreased.

This is because the lubricating oil which is conveyed is prevented by the overpressure from passing into the compression chamber (20) and on into the user installation. The lubricating oil may be conveyed by a pump action of the sealing elements of the piston (1) from the crank gear in the direction of the compression chamber (20). If lubricating oil passes into the compression chamber during overpressure-phases of the suction stroke, possibly after a gas loss through the sealing elements of the piston (1) it is pushed back by the earlier-mentioned overpressure during the subsequent compression stroke. The lubricating oil may be passed into the compression chamber by being sucked from the crank gear and past sealing elements of the piston (1), The advantage of the elimination or reduction of lubricating oil consumption can also be achieved by a further development of the gas compressor for the case of pressure regulator control. For this purpose, the inlet valve body (21) is replaced by a different inlet valve body (22) (FIGS. 1*a* and 1*b*) which is represented as floating in the compression chamber (20). Together with the passages (4) and (10), it constitutes an inlet valve (4, 22) and an additional valve (10, 22) respectively. These valves function in the same manner as the previously described valves with the same name. The other inlet valve body (22) differentiates itself from the previous one (21) in that it is provided with a reduced open area (25) instead of the open area (23) of the inlet valve body (21). Thus, inlet valve body (22) has a closed area (24) which overlaps the passage (18) between outlet chamber (15) and compression chamber (20) in its idling position (FIG. 1*a*). As a result, inlet valve body (22) together with passage (18) between outlet chamber (15) and compression chamber (20) constitute a closing valve (18, 22). This closing valve (18, 22) shuts off the connection between the compression chamber (20) and the outlet chamber (15) in the idling position. Because of this closing valve (18, 22), which is closed in idling position, the piston (1) is moved against overpressure or under overpressure as described for the case of the governor control, with the same advantage.

The idling stabilization pressure may increase, particularly in the case of governor control, due to a leaky outlet valve (17, 18). This danger can be counteracted by an overpressure valve (9), also called a safety valve, which limits the pressure in the compression chamber (20) and in the additional chamber (7) to a harmless value. Such overpressure valves (9) are known. An overpressure valve (9) is indicated with connection to the additional chamber (7) at the cylinder head (6). Such a valve can, however, also be installed with the same result at the cylinder (2), connected to the compression chamber.

In some applications the idling stabilization pressure which can be achieved by means of the additional chamber (7) is no longer sufficient. In such cases, the compression chamber (20) and the additional chamber (7) can be subjected by an appropriate device in the idling operation to pressure equal to the desired idling stabilization pressure. The appropriate device must become active simultaneously with the switching over of the gas compressor from load to idling. A further development for this goal is indicated by a pressure conduit (11), a supply container (13) and a valve (12). The pressure conduit (11) is shown on the cylinder head (6) connected to the additional chamber (7), but may also be located on the cylinder head (6) or on the cylinder (2) with connection to the compression chamber (20). Any valve designed to be controlled by a switching signal can be used as the valve (12). In the case where the supply pressure in the supply container (13) is greater than the predetermined pressure, the valve (12) must be able to limit the pressure accordingly or a separate pressure limiting valve of conventional design must be provided.

In some applications an especially large partial vacuum occurs in the suction chamber (8). Such a case may occur in automotive technology when the gas compressor, which is then normally acting as an air compressor, aspires from the intake manifold of a combustion engine, i.e., when the suction chamber (8) is connected to the intake manifold of the combustion engine. In such a case, if the sealing elements of the piston (1) are permeable so that gas escapes from the compression chamber (20) into the crank gear during the compression stroke of the piston (1) and replacement for the escaped gas must be aspired through the inlet valve (4, 21 in one embodiment or 4, 22 in another embodiment) from the suction chamber (8), a large partial vacuum may also occur in the compression chamber (20) during the suction stroke and in part during the compression stroke of the piston (1). This partial vacuum results in lubricating oil being sucked from the crank gear and past the sealing elements of the piston (1). To prevent this phenomenon, an extra suction valve can be provided by which the compression chamber (20) can be connected directly to the above-mentioned overpressure free relief environment. This limits the possible vacuum in the compression chamber (20) to a harmless level. In the exemplified embodiments of FIGS. 1*a* and 1*b*, the extra suction valve is constituted by a passage (19) in the cylinder head (6) between the relief environment or chamber (e.g., the atmosphere) and the compression chamber (20) and the appertaining inlet valve body (21 or 22). The inlet valve body (21 or 22) is provided with an additional closed area, not otherwise designated, to constitute this extra suction valve. The inlet valve body (21 or 22) with this closed area covers the passage (19) in its idling (FIG. 1*a*) position as well as in its load position (FIG. 1*b*). The operational description given above for the inlet valve (4, 21) applies to the operation of the extra suction valve (19, 21 in one embodiment or 19, 22 in another embodiment). In the case where the gas compressor is an air compressor whose relief space is the atmosphere, the opening of the passage (19) into the atmosphere can be preceded by a filter, as indicated in the figure without further designation.

Each of the passages mentioned so far (4, 10, 18, 19) can stand for several passages which form in their totality and together with the appertaining inlet valve body (21 or 22) or with the outlet valve body (17) or with several outlet valve bodies the respective valves as mentioned in the above-referenced publications.

The additional valve (10, 21 or 10, 22), the closing valve (18, 21 or 18, 22) and the additional suction valve (19, 21 or 19, 22) are shown in combination with the inlet valve (4, 21 or 4, 22) because they share the respective inlet valve body (21 or 22) with this inlet valve. In a manner not shown here the additional valve, the closing valve and the extra suction valve can also be designed as independent valves, or only as valves combined among each other, and may then be placed quite differently. In such a case, they must be provided with their own suitable drives to switch over between idling and load. The additional suction valve, for instance, could be located between the additional chamber (7) and the relief chamber.

Figure 2:
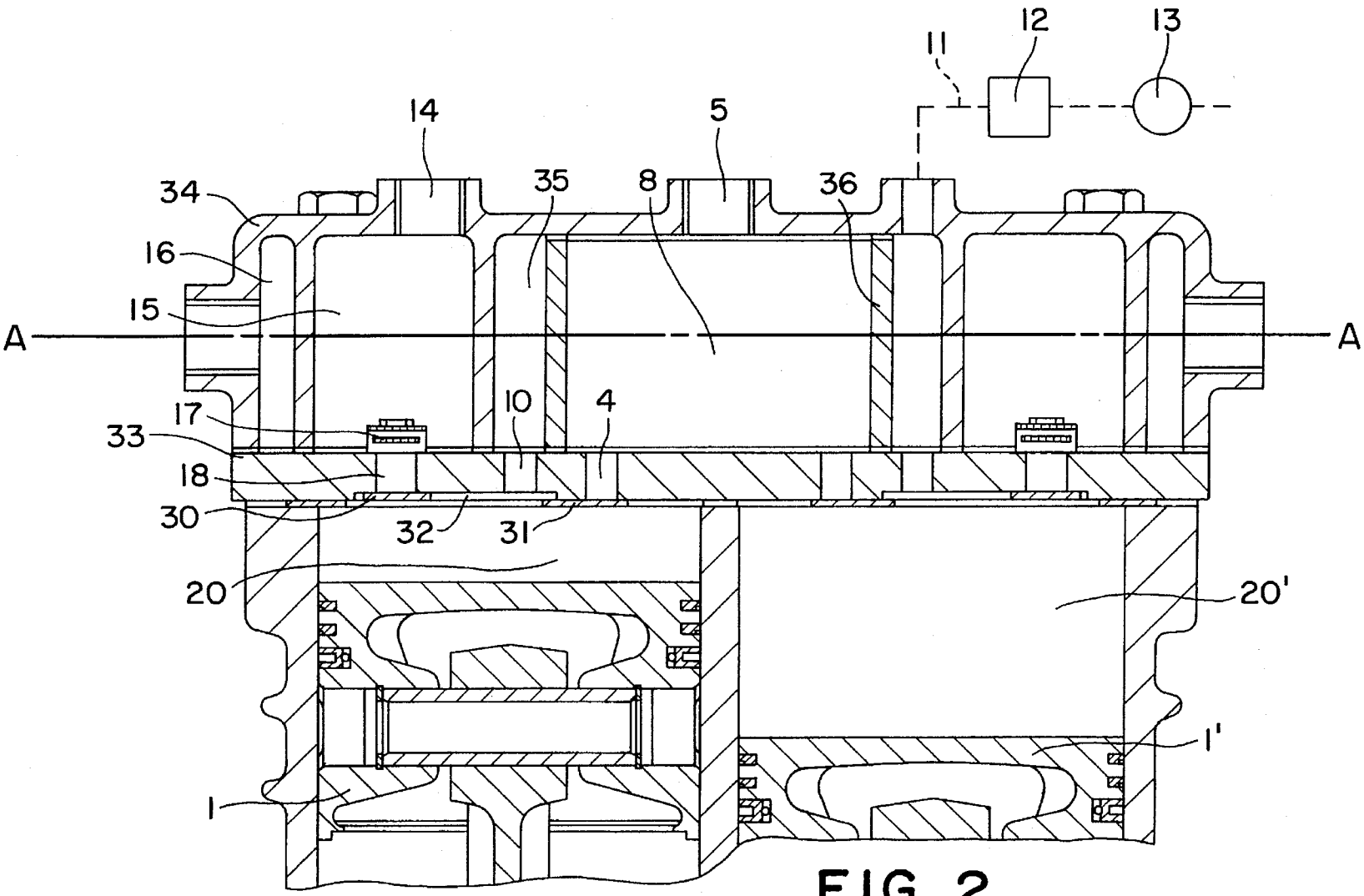
FIGS. 2 and 3 show a gas compressor in piston construction with two compression chambers in different sectional views.
Figure 3:
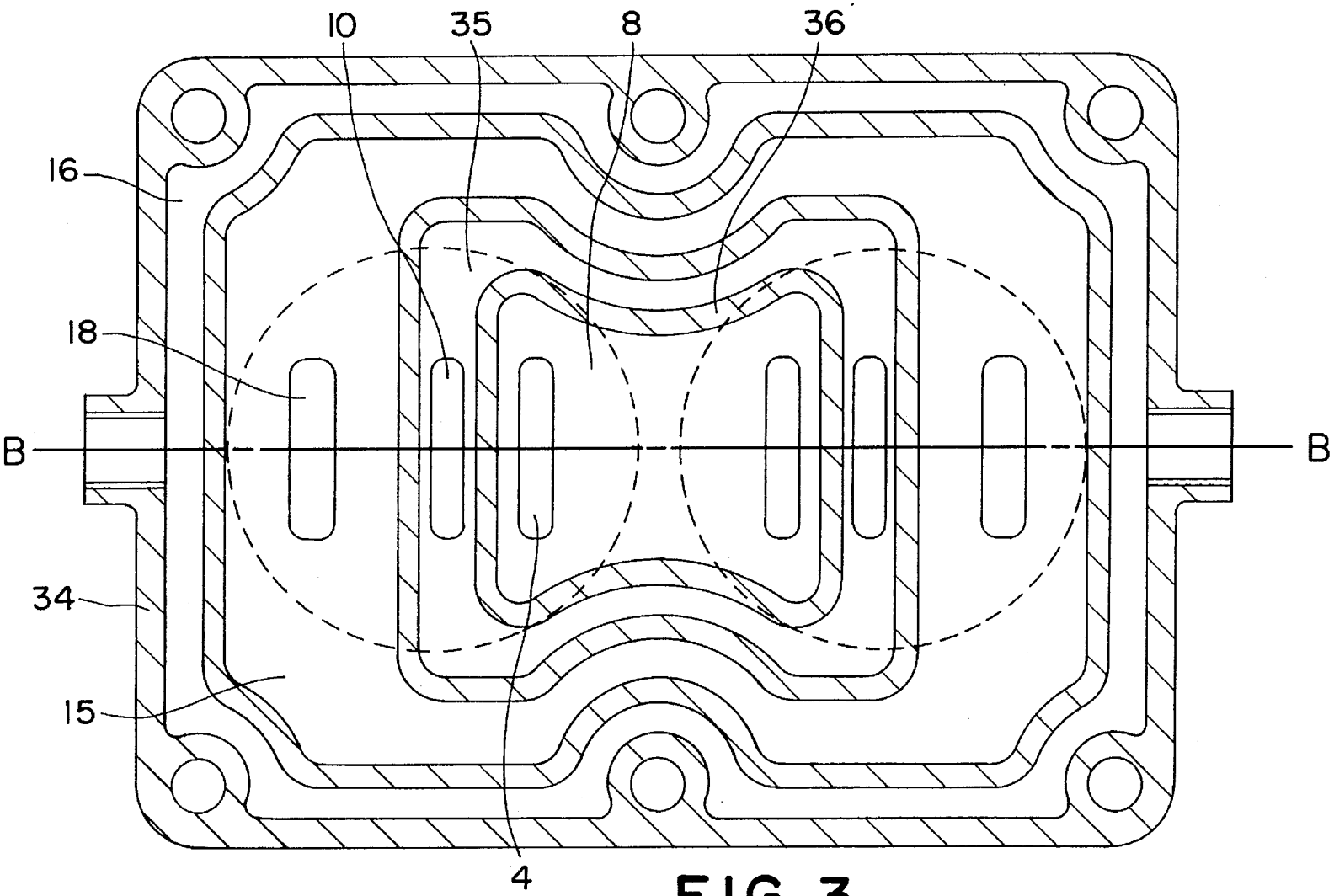

For the type of gas compressor shown in FIGS. 2 and 3 the designation "two-cylinder compressor" is customary.

FIG. 2 shows a longitudinal section through this gas compressor along cutting line B—B in FIG. 3. This gas compressor has an additional piston (1') which is normally similar to or identical with the previously mentioned piston (1). Furthermore, the two-cylinder gas compressor is provided with an additional compression chamber (20') assigned to the additional piston (1'). The pistons (1 and 1') are moved in opposite directions in the usual manner by the crank gear which is designed accordingly. For this reason the sizes of the compression chambers (20, 20') also change in opposition to each other, i.e., the size of one compression chamber (20 or 20') increases when the size of the other compression chamber (20' or 20) decreases.

The valves assigned to the compression chambers (20 and 20') are identical in construction so that the statements following hereunder for the valves assigned to the compression chamber (20) also apply to the valves assigned to the additional compression chamber (20').

The outlet valve (17, 18) is the same as the one of FIGS. 1*a* and 1*b*. The inlet valve body (31) is not capable of being shifted in this case between an idling position and a load position, but is fixedly held at one end. This end on the cylinder head (33, 34, 36) to be described below, or on the cylinder or on both does not overlap the passage (4) between the suction chamber (8) and the compression chamber (20) on the cylinder head (33, 34, 36). The inlet valve body (31) is controlled at its other end which overlaps the breach (4) due to its bending elasticity by the pressure surplus in the suction chamber (8) or in the compression chamber (20) so as to open or close the inlet valve (4, 31) as described in further detail for the embodiment according to FIG. 1, with respect to the inlet valve body (21 or 22).

The passages (10, 18) which serve for forming the additional valve, designated here by passage (10) and the valve body (30), and the outlet valve (17, 18) are located between the ends of the inlet valve body (31). However, the inlet valve body (31) is cut out near theses passages so that it does not influence their flow-through.

The cylinder head of this embodiment, consisting of a valve plate (33), a cylinder head body (34), an insert (36), and appertaining seals not designated, is countersunk in the area of the passages (10 and 18) on its surface towards the compression chamber (20). The inlet valve body (31) overlaps this countersunk area entirely or in part. As a result, a slit (32) is formed between the surface of the countersunk area and the surface of the inlet valve body (31) towards the cylinder head (33, 34, 36). A valve body (30) is guided in the slit (32). It constitutes the additional valve (10, 30) and the closing valve (18, 30) and is installed in the slit (32) so that it is able to glide or swivel between an idling position and a load position. In this case, the admixture valve (10, 30) and the closing valve (18, 30) are combined while the inlet valve (4, 31) is independent.

Similar arrangements of an inlet valve body and another valve body, including possible drives, are described in the German publications discussed above.

The valve body (30) is shown in its idling position during which it overlaps the passage (18) between the outlet chamber (15) and the compression chamber (20) and, thereby, constitutes the closing valve (18, 30). In an embodiment wherein the closing valve (18, 30) is not provided, an additional valve body (30) may be located in its idling position between the passages (10 and 18) as seen from the passage (4), on the other side of passage (10). In this case, the countersunk area in the cylinder head (33, 34, 36) can be correspondingly smaller.

The end of the passage (10) between the additional chamber and the compression chamber (20) which is away from the additional valve body (30) lets out into a channel (35) located in the cylinder head (33, 34, 36). In the idling position, the compression chambers (20 and 20') are connected with each other via the additional valves (10, 30) which are open and via the channel (35), so that the channel (35) and one of the compression chambers (20 or 20') associated with one of the pistons (1 or 1') jointly constitute the additional chamber (20', 35) or (20, 35) which is associated with the other compression chamber (20' or 20).

In this embodiment, the gas is pushed back and forth in idling operation over the additional valves (10, 30) and the channel (35) between the compression chambers (20 and 20'). In this process, an idling stabilization pressure builds up in the compression chambers (20 and 20'), as well as in the channel (35). This idling stabilization pressure is produced on the one hand by the advance of the piston (1 or 1') which is in the process of carrying out the suction stroke relative to the piston (1' or 1) which is in the process of carrying out the compression stroke. On the other hand, the idling stabilization pressure is produced by the flow losses in the additional valves (10, 30) and the channel (35). Due to the above-mentioned advance of the piston, the compression chamber (20 or 20'), whose piston (1 or 1') is just then in the process of carrying out the suction stroke, is larger than the other compression chamber over a large part of the piston-stroke, so that a tendency to decrease pressure in the larger compression chamber (20 or 20') ensues. The flow losses have a tendency for pressure increase in the compression chamber (20 or 20') whose piston (1 or 1') is just then carrying out the compression stroke and also for pressure decrease in the compression chamber (20' or 20) whose piston (1' or 1) is just then carrying out the suction stroke. The pressure decrease may lead to an intermittent opening of the appertaining inlet valve (4, 30) at the beginning of an idling operation and to after-suction from the suction additional suction chamber (8). The after-sucked gas additional section amount results in a pressure increase during the subsequent compression stroke. The additional suction effect ends when the pressure increase which it causes results in the pressure in the compression chambers (20 and 20'), and, thereby, also in the channel (35), to rise to such an extent that no pressure surplus remains in the suction chamber (8) during the suction stroke of the piston (1 or 1'). The overpressure occurring in the steady-state condition thus attained in the compression chamber (20 or 20'), whose piston (1 or 1') is then in the process of carrying out the compression stroke, is the idling stabilization pressure with the advantages mentioned in connection with the previous embodiment.

In the case of pressure regulator control, if the closing valve (18, 30) is not provided, the idling stabilization pressure leads to the opening of the outlet valve and, thereby, also during the idling operation, to a flow through the outlet conduit and the device for pressure regulation. This is advantageous in that the conduit and the device for pressure regulation cannot block up due to dirt or freezing, for example.

The above-mentioned possibility of increasing the idling stabilization pressure by introducing a predetermined pressure is especially important for this embodiment, because the idling stabilization pressure cannot be determined, or can be determined only to a limited extent in a two-cylinder compressor by the size of the additional chamber. As shown, the pressure conduit (11), the valve (12) and the supply container (13) which are suitable for this further development can be advantageously connected to the channel (35). The same applies, if required, to the overpressure valve and the extra suction valve.

The cylinder head (33, 34, 36) is further described below. Necessary passages (4, 10, 18) are provided in the valve plate (33) to constitute the inlet valve (4, 31), the outlet valve (17, 18), the admixture valve (10, 30) and the closing valve (18, 30).

FIG. 3 shows a cross-section through the cylinder head (33, 34, 36) along the section line A—A in FIG. 2.

FIG. 3 clearly shows in particular the positions of the chambers in the cylinder head (33, 34, 36) in relation to each other. The suction chamber (8) is surrounded by the channel (35) which is in turn surrounded by the outlet chamber (15). As a result the space taken up by the channel (35) is located between the suction chamber (8) and the outlet chamber (15). In the load operation, this arrangement has the advantage of lower heat transfer from the outlet chamber (15), which is then hot, to the suction chamber (8), and, thereby, the advantage of lesser heating of the suction flow and a higher delivery efficiency (volumetric efficiency).

Furthermore, FIG. 3 shows how the suction chamber (8) and also the outlet chamber (15) are common to both compression chambers (20, 20'). It is obvious that each compression chamber (20 or 20') can also be assigned its own suction chamber and/or its own outlet chamber.

As FIGS. 2 and 3 further show, the insert (36) serves to delimit the suction chamber (8) from the channel (35). The insert (36) makes it possible to provide a simple design for the cylinder head body (34) and easier mechanical machinability of same. Furthermore, the insert (36) provides a welcome generosity in the configuration of the chambers of the cylinder head (33, 34, 36), e.g., with the goal of obtaining optimal flow passages for the passages (4, 10, 18) necessary to form the earlier-mentioned valves.

The person schooled in the art will recognize that the cylinder head can also be made in one piece, or in a different manner in several pieces. Thus, for example, it may consist of a lid and a lower part, with an insert of the type described above being held between the lid and the lower part.

The person schooled in the art will also recognize that the explanations given above for one embodiment also apply for the other embodiment insofar as nothing to the contrary is contained in these explanations.

In conclusion it should be noted that the protection of the instant invention is not exhausted in the given examples or embodiments and further developments, but covers all embodiments the characteristics of which fall within the claims.

We claim:

1. A gas compressor switchable between load and idling operations, comprising a compression chamber, a suction chamber connected via at least one suction valve to said compression chamber, an outlet chamber connected via at least one outlet valve to said compression chamber, and an additional chamber connected during said idling operation to said compression chamber via an additional valve.

2. The gas compressor of claim 1, further comprising a closing valve for locking the connection between said compression chamber and said outlet chamber during said idling operation.

3. The gas compressor of claim 2, wherein said compression chamber and said additional chamber are subjected to a predetermined pressure during said idling operation.

4. The gas compressor of claim 1, further comprising an overpressure valve for limiting the pressure in the compression chamber and the additional chamber.

5. The gas compressor of claim 1, further comprising an extra suction valve for connecting said compression chamber to an atmospheric pressure chamber.

6. The gas compressor of claim 5, wherein said extra suction valve is located between said additional chamber and said atmospheric pressure chamber.

7. The gas compressor of claim 1, wherein said suction chamber is surrounded by said additional chamber.

8. The gas compressor of claim 7, wherein said suction chamber comprises an insert.

9. The gas compressor of claim 1, wherein said compression chamber is a first compression chamber, said suction chamber is a first suction chamber, said suction valve is a first suction valve, said outlet chamber is a first outlet chamber, said outlet valve is a first outlet valve, said additional valve is a first additional valve and said gas compressor further comprises at least one additional compression chamber, the size of which changes in opposition to the size of the first compression chamber, at least one additional suction chamber connected to said additional compression chamber via at least one suction valve, an additional outlet chamber connected via at least one additional outlet valve to said additional compression chamber, a channel connecting said first compression chamber to said additional compression chamber, said channel and one of said compression chambers forming an additional chamber associated with the other compression chamber, said first additional valve connecting said first compression chamber with said channel, and at least one other additional valve connecting said additional compression chamber with said channel during said idling operation.

10. The gas compressor of claim 9, wherein said first and additional suction chambers are combined.

11. The gas compressor of claim 10, wherein said combined suction chamber is surrounded by said channel.

12. The gas compressor of claim 11, wherein said combined suction chamber is formed by an insert.

13. The gas compressor of claim 9, wherein said first and additional outlet chambers are combined.

14. The gas compressor of claim 9, further comprising at least two closing valves for locking the connections between said compression chambers and said outlet chambers during said idling operation.

15. The gas chamber of claim 14, wherein said compression chambers and said channel are subjected to a predetermined pressure during said idling operation.

16. The gas compressor of claim 9, further comprising an overpressure valve for limiting pressure in said compression chambers and the channel.

17. The gas compressor of claim 9, further comprising at least one extra suction valve for connecting said compression chambers to an atmospheric pressure chamber.

18. The gas compressor of claim 17, wherein said extra suction valve is located between said channel and said atmospheric pressure chamber.

* * * * *

US005503537C1

(12) EX PARTE REEXAMINATION CERTIFICATE (8051st)

United States Patent
Schlossarczyk et al.

(10) Number: US 5,503,537 C1
(45) Certificate Issued: Mar. 1, 2011

(54) GAS COMPRESSOR

(75) Inventors: Heinrich Schlossarczyk, Wennigsen (DE); Werner Heger, Lehrte (DE)

(73) Assignee: Wabco Holdings Inc., Piscataway, NJ (US)

Reexamination Request:
No. 90/010,785, Feb. 12, 2010

Reexamination Certificate for:

| | |
|---|---|
| Patent No.: | **5,503,537** |
| Issued: | **Apr. 2, 1996** |
| Appl. No.: | **08/263,928** |
| Filed: | **Jun. 21, 1994** |

(30) Foreign Application Priority Data

Jun. 24, 1993 (DE) ..... 43 21 0139

(51) Int. Cl.
*F04B 49/22* (2006.01)

(52) U.S. Cl. ..... 417/296; 417/306; 417/439

(58) Field of Classification Search ..... None
See application file for complete search history.

(56) References Cited

U.S. PATENT DOCUMENTS

| | | | |
|---|---|---|---|
| 1,248,119 | A | 11/1917 | Holdsworth |
| 3,934,990 | A | 1/1976 | Ide, III |
| 4,472,112 | A | 9/1984 | Unger |
| 4,612,962 | A | 9/1986 | Purvis |
| 5,101,857 | A | 4/1992 | Heger et al. |

FOREIGN PATENT DOCUMENTS

| | | |
|---|---|---|
| DE | 520554 | 3/1931 |
| DE | 26 33 654 | 2/1977 |
| DE | 3909531 | 6/1990 |
| DE | 39 04 172 A1 | 8/1990 |
| EP | 0 372 154 B1 | 6/1990 |
| GB | 2192945 | 1/1988 |
| GB | 2217792 | 1/1989 |

OTHER PUBLICATIONS

R.J. Dale et al., Advances in Commercial Vehicle Air Compressor Technology, 6th Int'l Pacific Conference on Automotive Engineering, Society of Automotive Engineers of Korea.

Bendix 1A190R Air Compressor 2–Page Publication Dated Apr. 1991.

*Primary Examiner*—William C Doerrler

(57) ABSTRACT

The present invention relates to a gas compressor which prevents noise being produced in the suction conduit during idling. In conventional systems, the noise results from the collision of arriving and returning gas by means of a check valve provided between the suction chamber and the suction conduit. The present invention avoids this noise by providing an additional chamber which is connected via an admixture valve to the compression chamber (20) during the idling operation. This invention is especially applicable to pneumatic systems in automotive technology.

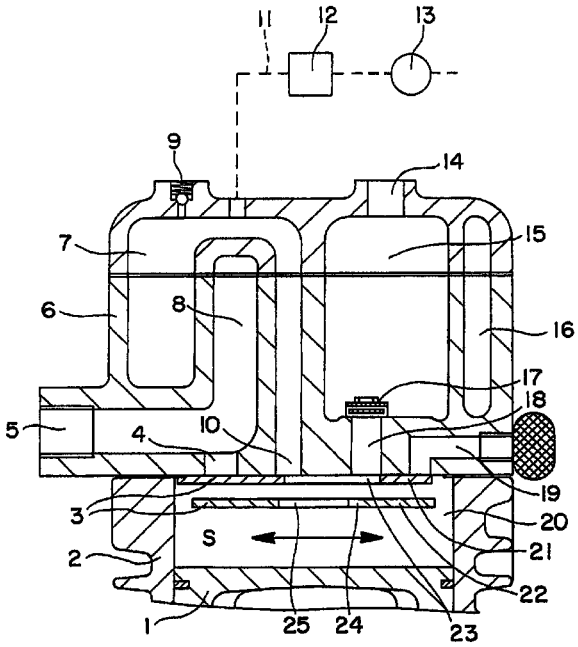

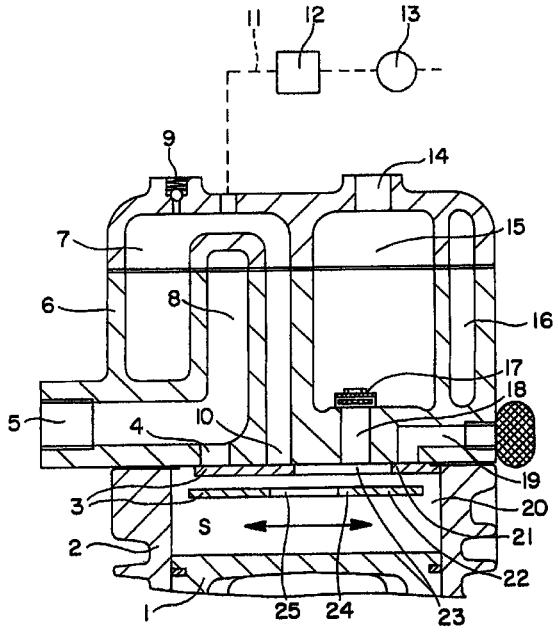

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3, 5 and 6 are determined to be patentable as amended.

Claim 4, dependent on an amended claim, is determined to be patentable.

New claims 19-29 are added and determined to be patentable.

Claims 7-18 were not reexamined.

1. A gas compressor *automatically* switchable between load and idling operations, comprising

*a cylinder;*

*a cylinder head;*

*a piston movable within said cylinder;* a compression chamber [,] *enclosed by said piston, cylinder and cylinder head;* a suction chamber *in said cylinder head* connected during *said load operation to said compression chamber* via at least one suction valve [to said compression chamber,] *;* an outlet chamber *in said cylinder head* connected *only during said load operation to said compression chamber* via at least one outlet valve [to said compression chamber,]*;* and an additional chamber *in said cylinder head, said additional chamber being* (*i*) *automatically* connected during said idling operation to said compression chamber via an additional valve, (*ii*) *isolated from said suction chamber and said outlet chamber in said cylinder head, and* (*iii*) *sized to attenuate pulsations to reduce noise during said idling operation.*

2. The gas compressor of claim 1, further comprising a closing valve for [locking] *automatically shutting off* the connection between said compression chamber and said outlet chamber during said idling operation.

3. The gas compressor of claim [2] *1*, wherein said compression chamber and said additional chamber are subjected to a predetermined *stabilization* pressure during said idling operation.

5. The gas compressor of claim 1, further comprising an extra suction valve for connecting said compression chamber to [an atmospheric pressure chamber] *at least one of atmosphere and an enclosed space at atmospheric pressure.*

6. The gas compressor of claim 5, wherein said extra suction valve is located between said additional chamber and [said atmospheric pressure chamber] *at least one of atmosphere and said enclosed space at atmospheric pressure.*

*19. A gas compressor automatically switchable between load and idling operations, comprising:*

*a cylinder;*

*a cylinder head having a suction chamber, an outlet chamber and an additional chamber, said additional chamber being isolated from said suction chamber and said outlet chamber in said cylinder head and sized to attenuate pulsations during said idling operation;*

*a piston movable within said cylinder;*

*a compression chamber enclosed by said piston, cylinder and cylinder head; and*

*an inlet valve body automatically movable along a surface of said cylinder head facing said compression chamber, said inlet valve body automatically establishing communication between said compression chamber and* (*i*) *said additional chamber during said idling operation, and* (*ii*) *said suction chamber and said outlet chamber during said load operation.*

*20. The gas compressor of claim 19, wherein said inlet valve body includes open and closed areas defined therein for controlling the flow of gas between the compression chamber and the cylinder head.*

*21. The gas compressor of claim 20, wherein said closed area overlaps* (*i*) *a passage between said compression chamber and said suction chamber during both said load and idling operations, and* (*ii*) *a passage between said compression chamber and said additional chamber during said load operation, and wherein said open area* (*i*) *exposes a passage between said compression chamber and said outlet chamber during both said load and idling operations, and* (*ii*) *at least partially exposes said passage between said compression chamber and said additional chamber during said idling operation.*

*22. The gas compressor of claim 20, wherein said closed area overlaps* (*i*) *a passage between said compression chamber and said suction chamber during both said load and idling operations,* (*ii*) *a passage between said compression chamber and said additional chamber during said load operation, and* (*iii*) *a passage between said compression chamber and said outlet chamber during said idling operation, and wherein said open area* (*i*) *at least partially exposes said passage between said compression chamber and said additional chamber during said idling operation, and* (*ii*) *exposes said passage between said compression chamber and said outlet chamber during said load operation.*

*23. The gas compressor of claim 19, wherein said inlet valve body is formed from an elastic material and flexes in response to pressure.*

*24. The gas compressor of claim 19, wherein said compression chamber and said additional chamber are subjected to a predetermined stabilization pressure during said idling operation.*

*25. The gas compressor of claim 19, further comprising an overpressure valve for limiting the pressure in said compression chamber and said additional chamber.*

*26. The gas compressor of claim 19, further comprising an extra suction valve for connecting said compression chamber to at least one of atmosphere and an enclosed space at atmospheric pressure.*

*27. The gas compressor of claim 26, wherein said extra suction valve is located between said additional chamber and at least one of atmosphere and said enclosed space at atmospheric pressure.*

*28. The gas compressor of claim 19, wherein said additional chamber at least partially surrounds said suction chamber.*

*29. The gas compressor of claim 19, wherein said additional chamber is defined by an insert in said suction chamber.*

* * * * *